US008844217B2

(12) United States Patent
Marchand

(10) Patent No.: US 8,844,217 B2
(45) Date of Patent: Sep. 30, 2014

(54) ENERGY-EFFICIENT FENESTRATION ASSEMBLIES

(75) Inventor: Norman Marchand, Felton, CA (US)

(73) Assignee: Clear Wall Corporation, Felton, CA (US)

( * ) Notice: Subject to any disclaimer, the term of this patent is extended or adjusted under 35 U.S.C. 154(b) by 7 days.

(21) Appl. No.: 13/635,958

(22) PCT Filed: Mar. 23, 2011

(86) PCT No.: PCT/US2011/029683

§ 371 (c)(1),
(2), (4) Date: Sep. 19, 2012

(87) PCT Pub. No.: WO2011/119774

PCT Pub. Date: Sep. 29, 2011

(65) Prior Publication Data

US 2013/0008101 A1 Jan. 10, 2013

Related U.S. Application Data

(60) Provisional application No. 61/316,829, filed on Mar. 23, 2010.

(51) Int. Cl.
*E06B 3/00* (2006.01)
*E06B 3/28* (2006.01)

(52) U.S. Cl.
CPC ..... *E06B 3/28* (2013.01)
USPC ..... 52/204.5; 52/204.1

(58) Field of Classification Search
CPC ..... E06B 1/30; E06B 1/702; E06B 3/30
USPC ..... 52/173.1, 204.1, 204.5, 208, 213, 52/656.1, 656.5, 656.7; 49/504; 428/428
See application file for complete search history.

(56) References Cited

U.S. PATENT DOCUMENTS

| | | | | |
|---|---|---|---|---|
| 3,466,821 | A * | 9/1969 | Cooper et al. | 52/204.1 |
| 5,302,449 | A * | 4/1994 | Eby et al. | 428/336 |
| 6,475,626 | B1 | 11/2002 | Stachowiak | |
| 6,632,491 | B1 | 10/2003 | Thomsen et al. | |
| 6,675,541 | B2 * | 1/2004 | Mackey | 52/208 |
| 8,240,107 | B2 * | 8/2012 | Gallagher | 52/656.9 |
| 2002/0176988 | A1 * | 11/2002 | Medwick et al. | 428/408 |

(Continued)

FOREIGN PATENT DOCUMENTS

| | | |
|---|---|---|
| CA | 1089732 | 11/1980 |
| WO | WO2004-083585 | 9/2004 |

OTHER PUBLICATIONS

Normand Marchand, Singapore Examination Report dated Feb. 10, 2014, Application No. 201207033-0.

*Primary Examiner* — Jeanette E Chapman
*Assistant Examiner* — James Buckle, Jr
(74) *Attorney, Agent, or Firm* — Ecotech Law Group, P.C.

(57) ABSTRACT

A fenestration assembly is described. The fenestration assembly includes: (1) a layer of film; (2) a frame having a first surface and a second surface, which is opposite to the first surface, the first surface substantially surrounding and having secured thereon the film and the frame having a thickness such that when the second side is fitted onto a window or a window frame, the thickness of the frame defines a space between the film and the window; and (3) wherein said film is a low-emittance film having an emissivity equal to or less than 0.35.

5 Claims, 14 Drawing Sheets

(56) References Cited

U.S. PATENT DOCUMENTS

| | | | | |
|---|---|---|---|---|
| 2003/0059623 | A1 | 3/2003 | O'Shaughnessy et al. | |
| 2003/0061783 | A1 | 4/2003 | Duncan et al. | |
| 2005/0028460 | A1* | 2/2005 | Steffek et al. | 52/204.5 |
| 2005/0034386 | A1* | 2/2005 | Crandell et al. | 52/204.5 |
| 2005/0138874 | A1* | 6/2005 | O'Shaughnessy et al. | 52/204.5 |
| 2006/0090834 | A1 | 5/2006 | Huang et al. | |
| 2008/0115451 | A1* | 5/2008 | Watanabe et al. | 52/745.19 |
| 2009/0151255 | A1* | 6/2009 | Haak et al. | 49/9 |
| 2010/0269432 | A1* | 10/2010 | Furgerson et al. | 52/213 |
| 2012/0297707 | A1* | 11/2012 | Lenz et al. | 52/204.593 |

* cited by examiner

ENERGY-EFFICIENT FENESTRATION ASSEMBLIES

RELATED CASE

The present application claims benefit, pursuant to the provisions of 35 U.S.C. §119, of U.S. Provisional Application Ser. No. 61/316,829, entitled "ENERGY-EFFICIENT FENESTRATION SUBASSEMBLIES," naming Normand Marchand as inventor, and filed on Mar. 23, 2010, the entirety of which is incorporated herein by reference for all purposes.

FIELD OF THE INVENTION

The present invention relates generally to fenestration assemblies. More particularly, the present invention relates to energy-efficient fenestration assemblies and methods of making the same.

BACKGROUND OF THE INVENTION

Fenestration refers to products that fill openings in a building envelope, such as windows, doors, skylights, curtain walls, etc. These products are designed to permit the passage of air, light, vehicles, or people. A building envelope, in turn, generally refers to the separation between the interior and the exterior environments of a building. As such, the building envelope serves as an outer shell that both protects and facilitates climate control of the indoor environment.

During daylight hours, people typically draw blinds to reduce or eliminate the glare caused by the sun light piercing through a window. This blocks a substantial portion of the view from the window, and thereby defeats the purpose of having a window in the first place. As a result, there has been an effort to modify a window by directly applying on it a glare-reducing film that is transparent enough to not obscure the view through the window.

FIG. 1 shows a modified window 10 including a surrounding frame 14, secured within which is a window 12. According to this figure, a glare-reducing film 16 directly attaches to an interior surface of window 12. The term "interior surface," as used in this specification refers to the surface which is inside the building envelope. Furthermore, a combination of a film (e.g., glare-reducing film 16) directly attached to a window (e.g., window 12) is hereinafter referred to as "a window/film combination."

Glare-reducing film 16 commonly includes aluminum, which is incorporated into the film matrix by either well-known sputtering or vapor deposition methods. An exemplar of such a film is Silver 35, which is commercially available from 3M Corporation of Minneapolis, Minn. The incorporated aluminum composition in this film reflects a certain amount of light (e.g., about 35%) impinging upon the window/film combination. The film is also designed to reflect a certain amount of heat (e.g., between about 30% and about 50%) that strikes the interior surface of a window.

When using glare-reducing films, a certain amount of light (e.g., sun light) that impinges upon a window/film combination reflects back to the exterior of the building. During summer season, greater reflection of light keeps out greater amount of heat associated with that light from the building's interior and allows cooler temperatures to prevail inside the building envelope.

Similarly, a certain amount of heat that is contained in an interior of a building envelope reflects back by a window/film combination. During winter season, greater reflection of heat allows a greater amount of heat retention inside the building's interior and allows for warmer temperature to prevail inside the building envelope.

Unfortunately, directly applying a film to the interior surface of a window, as conventional designs propose, suffers from drawbacks. Specifically, the amount of light and heat that is reflected does not rise to the desired high levels to be considered energy efficient. In fact, the conventional window/film combinations absorb a greater than desired amount of light impinging upon it or greater than desired amount of heat contained inside the building envelope.

Significant amount of light that is absorbed by a window/film combination is converted to heat. Thus, regardless of whether heat or light passes through a window/film combination, in both cases ultimately heat is absorbed heat by the window/film combination. In other words, during summer season, a conventional window/film combination absorbs and transmits to the building interior a greater amount of heat than is desirable, and during winter season, heat losses through a conventional window/film combination are greater than desirable. In both seasons, the amount of heat absorbed by the conventional window/film combination places an excessive load on an air-conditioning unit which is working to regulate the temperature inside the building envelope.

What are therefore needed are energy-efficient systems and methods which reduce the load on air-conditioning units regulating the temperature inside the building envelope.

SUMMARY OF THE INVENTIONS

In response to this need, the present invention provides inventive fenestration assemblies, which in preferred embodiments provide a certain distance between a film and a window. In other words, it is not necessary to directly apply a film to a window, as it is in conventional window/film combinations. The distance between the window and the film serves to reduce the rate of heat transfer through the inventive fenestration assemblies. As a result, heat that is absorbed by the inventive fenestration assemblies is transferred in or out of the building envelope at a much slower rate, making the inventive assemblies significantly more energy efficient.

In one aspect the present invention provides a fenestration assembly. The fenestration assembly, includes: (1) a layer of film; (2) a frame having a first surface and a second surface, which is opposite to the first surface, the first surface substantially surrounding and having secured thereon the film and the frame having a thickness such that when the second surface is fitted onto a window or a window frame, the thickness of the frame defines a space between the film and the window; and (3) wherein the film is a low-emittance film having an emissivity equal to or less than 0.35.

In this embodiment, the thickness of the frame introduces the desired space or distance between the window and the low-emittance film to reduce the rate of heat transfer through the fenestration assembly. In accordance with one embodiment of the present invention, the thickness of the frame is between about 1/16 inch and about 6 inches, and is preferably between about 0.5 inch and about 1 inch.

Furthermore, the frame may be made from at least one member selected from a group consisting of wood, vinyl and metal. In certain preferred embodiments of the present invention, the frame is insulated with a material such that a thermal resistivity measurement of the frame is substantially similar to a thermal resistivity measurement of the film.

Although there is no limitation on the type of material used to make the film, the film is preferably made from at least one material selected from a group consisting of polyester, metal and a UV inhibitor. The film may generally have a thickness that is between about 1.5 mils and about 15 mils. In a preferred embodiment of the present invention, however, the thickness is between about 2 mils and about 12 mils. Although it is desirable to use a film having an emissivity of less than or equal to 0.35, the film preferably has an emissivity that is between about 0.08 and about 0.01, and more preferably has an emissivity of about 0.05.

In another aspect the present invention provides another fenestration assembly. The fenestration assembly includes: (1) a layer of film; (2) a frame having a first surface and a second surface, which is opposite to the first surface, the first surface substantially surrounding and having secured thereon the film; (3) a spacer attached to the first surface or the second surface and when the spacer is fitted onto a window or window frame, the spacer defines a space between the film and the window; and (4) wherein the film is a low-emittance film having an emissivity equal to or less than 0.35. In this embodiment, the spacer introduces the desired space or distance between the window and the low-emittance film to reduce the rate of heat transfer through the fenestration assembly. In accordance with one embodiment of the present invention, the thickness of the spacer is between about 1/16 inch and about 6 inches, and is preferably between about 0.5 inch and about 1 inch.

The spacer may be made from at least one material selected from a group consisting of plastic, magnet and a fluid sealant material. The frame may be made from at least one member selected from a group consisting of wood, vinyl and metal. The frame is preferably insulated with a material such that a thermal resistivity measurement of the frame is substantially similar to a thermal resistivity measurement of the film.

In accordance with one embodiment of the present invention, the low-emittance film is made from at least one material selected from a group consisting of polyester, metal and a UV inhibitor. The low-emittance film has a thickness that is generally between about 1.5 mils and about 15 mils, and is preferably between about 2 mils and about 12 mils. The emissivity is preferably between about 0.08 and about 0.01, and is more preferably about 0.05.

In yet another aspect, the present invention provides another fenestration assembly. The fenestration assembly includes: (1) a frame having a first surface and a second surface, which is opposite to the first surface, the frame having a thickness; (2) a protective layer attached to the first surface and the first surface surrounding the protective layer; (3) a low-emittance film having an emissivity equal to or less than 0.35, and the low-emittance film attached to and surrounded by the second surface of the frame, such that the thickness of the frame defines a space between the protective layer and the low-emittance film; and (4) wherein the low-emittance film is positioned adjacent to the window when the fenestration assembly is installed to cover a window and the low-emittance film in that configuration is designed to reduce energy loss through the window.

In this aspect, the frame is made from at least one member selected from a group consisting of wood, vinyl and metal. It may have a thickness that is generally between about 1/16 inch and about 6 inches, and preferably between about 0.5 inch and about 1 inch.

In a preferred embodiment of the present invention, the frame is insulated with a material such that a thermal resistivity measurement of the frame is substantially similar to a thermal resistivity measurement of the film. The frame may be a hollow structure and may include a desiccant. The desiccant preferably includes at least one material selected from a group consisting of silica gel, activated charcoal, calcium sulfate, calcium chloride, montmorillonite clay, and molecular sieves.

In preferred embodiments of the present invention, the low-emittance film is made from at least one material selected from a group consisting of polyester, metal and a UV inhibitor. The low-emittance film generally has a thickness that is between about 1.5 mils and about 15 mils, and preferably has a thickness that is between about 2 mils and about 12 mils. The emissivity of the film is generally between about 0.08 and about 0.01, and is preferably about 0.05.

The protective layer in one embodiment of the inventive fenestration assemblies includes at least one material selected from a group consisting of glass, plastic or polyester. This layer generally has a thickness that is between about 2 mils and about 1/4 inch.

In one preferred embodiment of the present invention, the fenestration assembly further includes a foam material disposed around an outer boundary of the frame such that by fitting the foam material inside a cavity created by a window frame, which surrounds the window, the fenestration assembly covers the window. In this embodiment of the present invention, the spacer may be absent and the frame may not be thick enough to define a requisite distance between the film and the window. By installing the fenestration assembly into the cavity a certain distance away from the window, the desired distance to reduce energy transfer is achieved. As a result, it is not necessary to have a frame or spacers of a certain thickness in certain embodiments of the present invention to achieve energy efficiency.

In another preferred embodiment of the present invention, the fenestration assembly further includes a connecting member disposed on the second surface or on the low-emittance film near the second surface, and the connecting member includes at least one material selected from a group consisting of foam, magnet, plastic, screw, tape and glue, and the connecting member is designed to maintain a distance between the low-emittance film and the window. The connecting member may have a length that is between about 1/16 inch and about 6 inches.

In yet another preferred embodiment of the inventive fenestration assemblies, a support layer is included. The support layer is disposed between the protective layer and the low-emittance film such that the support layer supports the low-emittance film and the protective layer. The support layer may include at least one material selected from a group consisting of glass, plastic and polyester. If polyester is used, then the support layer may be in the form of a polyester film. In those embodiments where the support layer includes a polyester film, it includes one or more vertical support beams and one or more horizontal support beams that intersect each other at approximately 90° and form a grid, and the one or more vertical support beams and the one or more horizontal support beams have a thickness that is substantially equal to the thickness of the frame. This allows the support layer to provide mechanical support to the low-emittance film and the protective layer.

The inventive fenestration assemblies preferably further include a plurality of mounts, each of which are positioned on the low-emittance film at a location that corresponds to the point of intersection of the one or more vertical support beams and one or more horizontal support beams of the support film, wherein the mounts maintain a distance between the low-emittance film and the window when the fenestration assembly is installed on a window or a window frame. In one embodiment of the present invention, mounts maintain a distance between the low-emittance film and the window that is a value between about ⅙ inch and about 6 inches.

In yet another aspect, the present invention provides another fenestration assembly. The fenestration assembly includes: (1) a first frame having a first surface and a second surface; (2) a second frame having a first surface and a second surface; (3) a low-emittance film having an emissivity equal to or less than 0.35 and the low-emittance film sandwiched between the first and the second frames such that the low-emittance film adheres to the second surface of the first frame on one side and adheres to the first surface of the second frame on the other side; (4) a relatively thin protective film adhering to a first surface of the first frame, the relatively thin protective film is disposed adjacent to and faces a window when the fenestration assembly is installed on the window or a window frame, which surrounds the window; and (5) a relatively thick protective film adhering to a second surface of the second frame, the relatively thick protective film faces opposite to the window when the fenestration assembly is installed on the window or the window frame.

In this aspect, the relatively thin protective film has a thickness that is generally between about 0.5 mil and about 6 mils and the relatively thick protective film has a thickness that is generally between about 2 mils and about ¼ inch. The low-emittance film may be made from at least one material selected from a group consisting of polyester, metal and a UV inhibitor and has a thickness that may be between about 1.5 mils and about 12 mils. In preferred embodiments of the present invention, however, the thickness of the low-emittance film is between about 2 mils and about 4 mils.

In accordance with certain preferred embodiments of the present invention, the fenestration assembly may further include a first foam material and a second foam material, wherein the first foam material is disposed around an outer boundary of the first frame and the second foam material is disposed around an outer boundary of the second frame, such that by fitting the first foam material and the second foam material inside a cavity created by the window frame the fenestration assembly is installed on the window or the window frame. In this embodiment, neither a spacer nor a frame of requisite thickness is required to introduce a distance between the relatively thin protective layer and the window. By installing the fenestration assembly a certain distance away from the cavity, the required distance between the relatively thin protective layer and the window is achieved.

In other preferred embodiments of the present invention, the fenestration assembly may further include a connecting member disposed on the first surface of the first frame or on the relatively thin protective film near the first surface of the first frame. In such embodiments, the connecting member includes at least one material selected from a group consisting of foam, magnet, plastic, screw, tape and glue. Furthermore, in these embodiments of the present invention, the connecting member is designed to maintain a distance between the relatively thin protective film and the window when the connecting member connects to the window or the window frame.

The construction and method of operation of the invention, however, together with additional objects and advantages thereof will be best understood from the following descriptions of specific embodiments when read in connection with the accompanying figures.

DETAILED DESCRIPTION OF THE PREFERRED EMBODIMENTS

In the following description, numerous specific details are set forth in order to provide a thorough understanding of the present invention. It will be apparent, however, to one skilled in the art that the present invention may be practiced without limitation to some or all of these specific details. In other instances, well known process steps have not been described in detail in order to not unnecessarily obscure the invention.

Figure 2A:
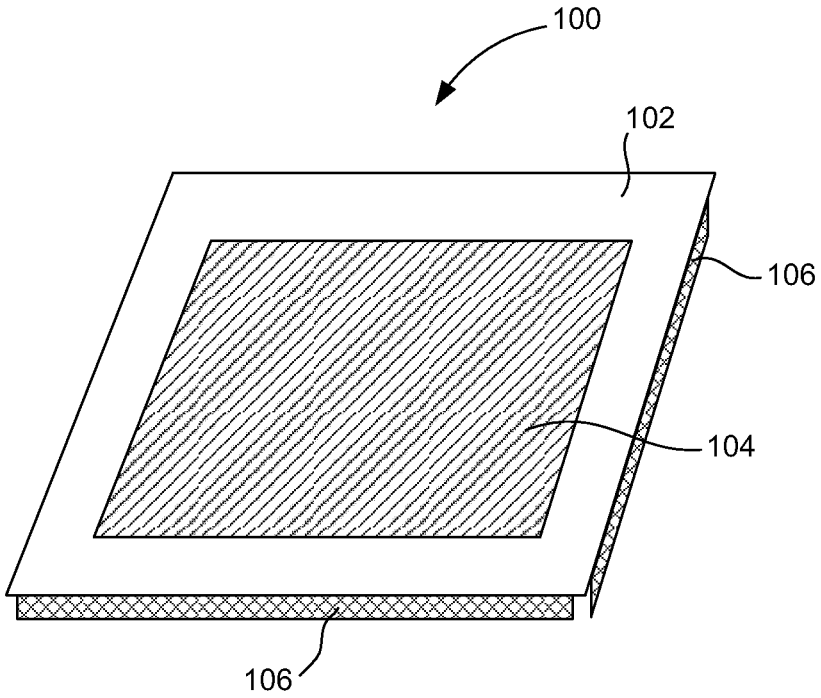
FIG. 2A shows a perspective view of a fenestration assembly, according to one embodiment of the present invention, which includes a film secured on a frame having spacers.

FIG. 2A shows a perspective view of a fenestration assembly 100, according to one embodiment of the present invention. Fenestration assembly 100 includes a film 104, which is secured on a frame 102. Spacers 106 are attached to frame 102. As will be explained later, when a fenestration assembly is installed on a window (e.g., shown as window 212 in FIG. 3) or installed on a window frame (e.g., as shown in FIG. 4A), spacers provide a space or a distance between the film (e.g., film 104 of FIG. 2A) and the window.

Frame 102 is made from any rigid material that is sturdy enough to support spacers 106 and film 104, which is made from a relatively thin and flimsy material. By way of example, the frame is made from at least one material selected from a group consisting of wood, vinyl, polystyrene and metal. Embodiments of the present invention, in which the frame is made from metal or aluminum, are preferred as they are sturdy enough and relatively inexpensive to manufacture.

The present invention recognizes that energy loss through a frame can be significant. As a result, in certain preferred embodiments of the present invention, frame 102 is insulated with a material such that a thermal resistivity measurement of frame 102 is substantially similar to a thermal resistivity measurement of film 104. By way of example, the frame can be properly insulated using a polystyrene based material.

Figure 4A:
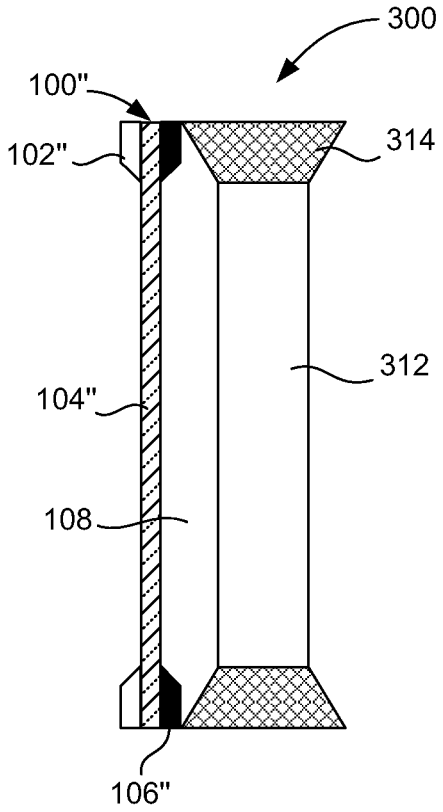
FIG. 4A shows a side-sectional view of the fenestration assembly shown in FIG. 2A that is sized to fit a window and the surrounding window frame.

The dimensions of frame 102 vary to fit over different sizes of windows and window frames (e.g., window frame 314 of FIG. 4A). A thickness of frame 102 is a value that is generally between about 1/16 inch and about 6 inches. In preferred embodiments of the present invention, however, the thickness is between about ½ inch and about 1 inch.

Figure 1:
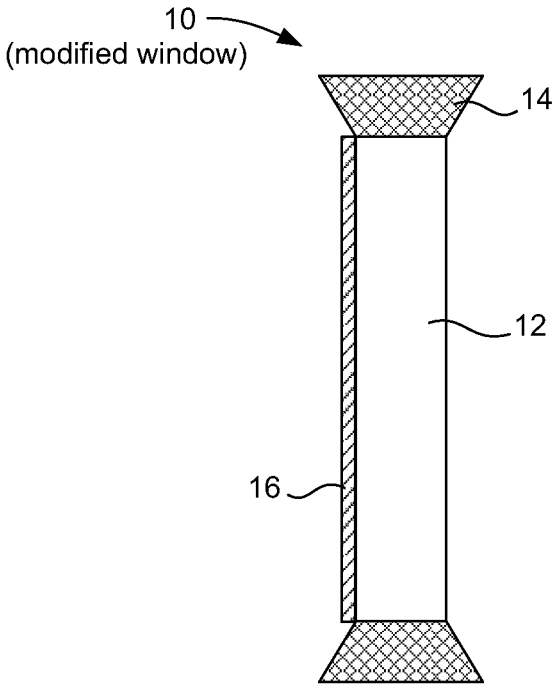
Figure 1 (Prior Art)
FIG. 1 shows a side-sectional view of a conventional window/film combination, which includes a film directly adhering to a window.

In one embodiment of the present invention, film 104 is a low-emittance film because it has energy efficient properties. Low-emittance films that are currently commercially available, however, include an adhesive coating on one side of the film such that the film is directly applied to the window to form a conventional window/film design shown in FIG. 1. Examples of such commercially available films are Silver 35, which is commercially available from 3M Corporation of Minneapolis, Minn., and V Kool, which is commercially available from Southwall Technologies Inc. of Palo Alto, Calif. These low-emittance films do not lend themselves to be incorporated into the fenestration assemblies of the present invention. At least for these reasons, those skilled in the art are not motivated to use a low-emittance films as described by the present invention.

To this end, CW 1435, which is commercially available from Clear Wall Corporation of Felton, Calif., represents a preferred embodiment of the present invention because this newly introduced film does not include the undesired adhesive coating.

Films incorporated in the fenestration assemblies of the present invention are preferably made from at least one material selected from a group consisting of polyester, metal and a UV inhibitor. These films have a shiny side and on the opposite side have a low emittance property. When the fenestration assemblies of the present invention are installed, the "low-emittance" side is typically the room side, i.e., the side which has the low emittance property faces the room. In this configuration, the shiny side faces the exterior or the sun. These films generally have a thickness that is between about 1.5 mils and about 15 mils, and preferably have a thickness that is between about 2 mils and about 12 mils.

The term "low-emittance film," as used in this specification refers to a film having an emissivity equal to or less than 0.35. Emissivity of a film indicates the ability of the film to transmit radiant heat energy that impinges upon it at room temperature. A low emissivity value for a film means that small amount of radiant heat energy impinging upon it is transmitted through the film and that typically a higher amount of the impinging radiant heat energy is reflected back. Low-emittance films or coating represent a preferred embodiment of the present invention because, from a performance point of view, they: (a) drastically reduce the heat escaping through the windows in winter season by reflecting the heat back inside the building; (b) maintain low temperatures inside a building by reflecting back heat that is absorbed through the window during summer season; and (c) possess excellent solar control performance characteristics for reducing solar energy, glare, and ultraviolet radiation.

In preferred embodiments of the present invention, film 104 has an emissivity that is between about 0.01 and about 0.08 and in more preferred embodiments of the present invention, the emissivity is about 0.05. In addition to emissivity, film 104 preferably possesses other performance characteristics such as solar heat reduction, total solar energy reflected, glare reduction, visible light transmitted, ultraviolet radiation rejected, solar reflectance, shading coefficient, solar heat gain coefficient and U-factor.

Solar heat reduction is a ratio of the difference in total solar energy entering before and after installing film on the window to total solar energy entering through the window with no film. Solar heat reduction for a low-emittance film, which is used in connection with a window made from clear glass and implemented in accordance with various embodiments of the present invention, is generally a value that is between about 50% and about 88%.

Total solar energy reflected is a ratio of the difference in solar energy entering the interior (including both transmitted and re-radiated energy) through a window and a film to total solar energy impinging on the window. Total solar energy reflected for a low-emittance film, which is used in connection with a window made from clear glass and implemented in accordance with various embodiments of the present invention, is generally a value that is between about 50% and about 95%.

Glare reduction refers to a ratio of the difference in visible transmission of a window before and after installing film to visible transmission of the window before installing the film. Glare reduction for a low-emittance film, which is used in connection with a window made from clear glass and implemented in accordance with various embodiments of the present invention, is generally a value that is between about 30% and about 65%.

Visible light transmitted refers to a ratio of a human eye weighted average daylight (in the visible spectrum, i.e., approximately 380 nm to approximately 720 nm) that is transmitted through a window to daylight which is incident upon the window. Visible light transmitted for a low-emittance film, which is used in connection with a window made from clear glass and implemented in accordance with various embodiments of the present invention, is generally a value that is between about 35% and about 70%.

Ultraviolet radiation reflected refers to a ratio of the difference in ultraviolet radiation entering the interior (including both transmitted and re-radiated energy) through a window and a film to ultraviolet radiation impinging on the window. For a low-emittance film, which is used in connection with a window made from clear glass and implemented in accordance with various embodiments of the present invention, is a value that is about 99%.

Solar reflectance refers to a ratio of reflected solar energy from a film to solar energy incident on the film. For a low-emittance film, solar reflectance is a value that is between about 8% and about 58%.

Shading coefficient refers to a ratio of solar energy entering through a window compared to that which enters through a window made from clear ⅛" (3 mm) double strength sheet glass. For a low-emittance film, which is used in connection with a window made from clear glass and implemented in accordance with various embodiments of the present invention, is a value that is between about 0.17 and about 0.30.

Solar heat gain coefficient ("SHGC") refers to the fraction of solar radiation admitted through a window or skylight, both directly transmitted, and absorbed and subsequently released inward. It is expressed as a number between 0 and 1. When a window has an opening, which is not covered with glass, then the window has a SHGC of 0. If that window is covered with a wall, then it has a SHGC of 1. The lower a window's SHGC, the less solar heat it transmits, and the greater its shading ability. SHGC can be expressed in terms of the glass alone or can refer to the entire window assembly. By way of example, for a low-emittance film, which is used in connection with a window made from clear glass and implemented in various embodiments of the present invention, SHGC has a value that is between about 0.10 and about 0.30.

U factor or U value, as it is sometimes called, refers to a measurement used in determining the ability of different structural components (such as films or windows) to conduct heat. For a low-emittance film, which is used in connection with a window made from clear glass and implemented in various embodiments of the present invention, U factor has a value that is between about 0.015 $W/m^2/°$ C. and about 0.35 $W/m^2/°$ C.

Figure 3:
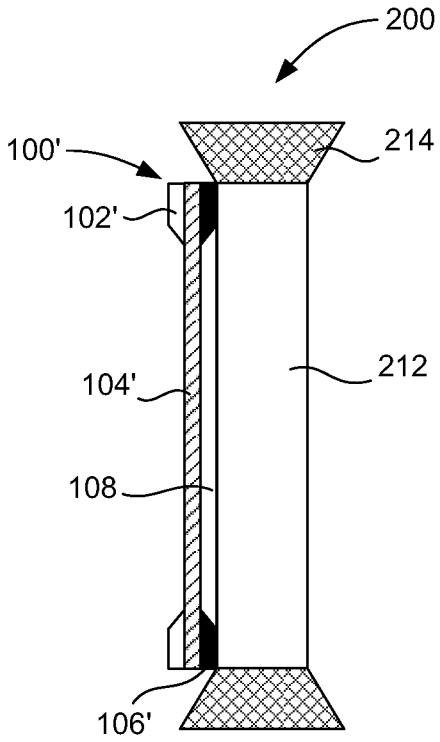
FIG. 3 shows a side-sectional view of the fenestration assembly shown in FIG. 2A that is sized to fit a window.

Spacers 106 can be made from any material that produces a dead air space (e.g., space defined by reference numeral 108 shown in FIG. 3 and described below) between the window and film 104 (shown as film 104' in FIG. 3) when a fenestration assembly is fitted onto a window (e.g., when fenestration assembly 100' is fitted on to window 212 of FIG. 3). The air space is considered "dead" because there is no substantial air flow in and out of that space. Spacers 106 may be made from at least one material selected from a group consisting of foam, plastic, magnet and a fluid sealant material. Preferably, however, spacers 106 are made from foam (e.g., open-cell and closed-cell foam materials), which is typically used in insulation. More preferably, spacers 106 are made from a dense, closed-cell foam material, which does not allow any appreciable air flow into and out of dead air space. By way of example, the thickness of spacers 106 is a value between about 1/16 inch and about 6 inches. Preferably, however, the thickness of spacers 106 is between about 0.5 inch and about 1 inch.

According to FIGS. 2A and 3, the thickness of spacers 106 dictates the distance between film 104 and a window when fenestration assembly is installed. As a result, the distance between film 104 and the window after installation of the fenestration assembly, is between about 1/16 inch and about 6 inches and preferably between about ½ inch and about 1 inch.

It is noteworthy that spacers are not necessary to create a space between film 104 and the window. Rather a frame (e.g., frame 102 of FIG. 2A) of appropriate thickness can be selected to create a space between film 104 and the window. It is also possible to create a requisite space by partially relying on the thickness of frame 104 and partially relying on spacers 106. As will be explained below in connection with FIG. 2B, a space between a film and window can also be created by neither relying on a frame of a certain thickness nor relying on spacers. As a result, it is not necessary to have a frame of certain thickness or spacers to achieve a requisite thickness between a film and a window as shown in FIG. 3.

Figure 2B:
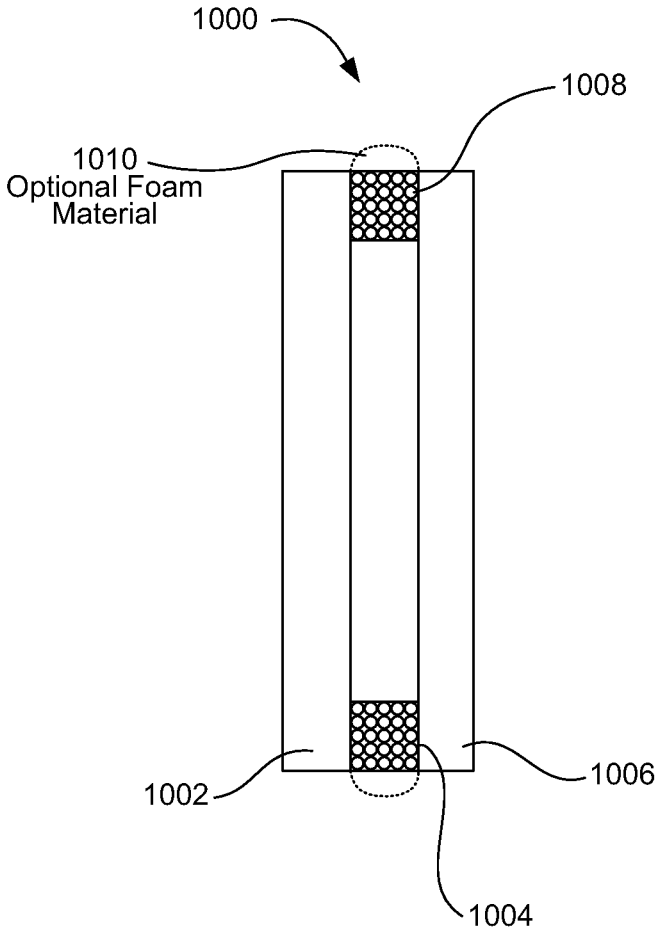
FIG. 2B shows a side-sectional view of another fenestration assembly, according to another embodiment of the present invention, which is in the form of a cartridge that includes, among other items, a protective film, a frame and a low-emittance film, and that optionally includes a foam material disposed around the frame such that the foam is capable of fitting into a cavity created by a window frame.

FIG. 2B shows a fenestration assembly 1000, according to another embodiment of the present invention. Fenestration assembly 1000 can be thought as a cartridge that attaches to a window or window frame. According to FIG. 2B, fenestration assembly 1000 includes a frame 1004 that is sandwiched between a protective layer 1002 and a low-emittance film 1006. In this configuration, protective layer 1002 adheres to a first surface of frame 1004 and low-emittance film 1006 adheres to a second surface of frame 1004. The thickness of frame 1004 creates a space between protective layer 1002 and low-emittance film 1006. Furthermore, frame 1004 is a hollow structure that contains a desiccant 1008, which is designed to absorb any moisture that may accumulate in the space between protective layer 1002 and low-emittance film 1006.

It is not necessary that protective layer 1002 and low-emittance film 1006 extend the length of the frame as shown in FIG. 2B. In certain embodiments of the present invention, these layers are long enough to be secured (e.g., by gluing them) on the two surfaces of frame 1004 such that they properly cover both surfaces and effectively seal the space between them.

As an optional feature, fenestration assembly 1000 includes a foam material 1010 that is disposed around an outer boundary of frame 1004. Foam material 1010 facilitates in the installation of fenestration assembly 1000. Specifically, the soft and flexible characteristics of foam material 1010 allow it to be forced into a cavity formed by a window frame that surrounds a window. In this fitted position of fenestration assembly 1000 inside the cavity, low-emittance film 1006 faces and covers the window and protective layer 1002 faces opposite to the window or window frame. Protective layer 1002 serves to protect fenestration assembly 1000 from external forces that may be applied by humans, window shades or blinds, etc.

Frame 1004 and film 1006 of FIG. 2B are substantially similar to frame 102 and film 104 of FIG. 2A, respectively. Protective layer 1002 is made from at least one material that is selected from a group consisting of glass and plastic. In preferred embodiments of the present invention, protective layer 1002 is made from plastic (e.g., acrylic and bomb blast film). More preferably, however, protective layer 1002 is made from bomb blast film.

Protective layer 1002 is generally a relatively thick film that is capable of withstanding and absorbing external forces encountered by humans, window shades or blinds. In preferred embodiments of the present invention, however, protective layer 1002 has at thickness of between about 2 mils and about ¼ inch.

Although desiccant 1004 in FIG. 2B is shown in ball shapes, in other embodiments of the present invention, it can be present as a desiccant strip or coating inside or outside the frame. By way of example, desiccant 1004 includes at least one material selected from a group consisting of silica gel, activated carbon, calcium sulfate, calcium chloride, montmorillonite clay and molecular sieves.

Figure 2C:
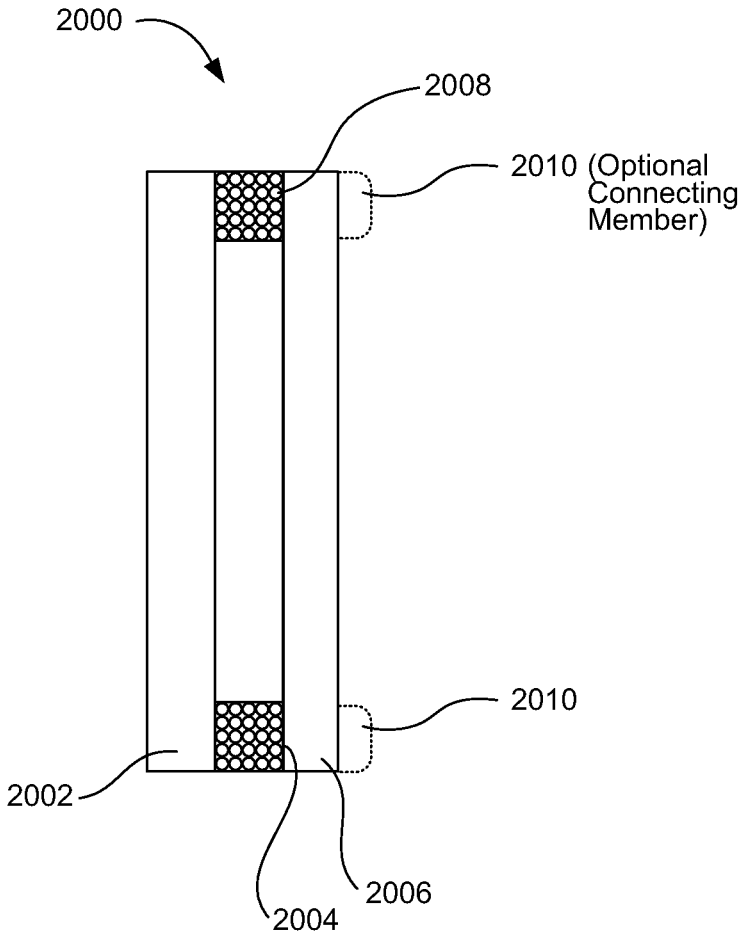
FIG. 2C shows a side-sectional view of yet another fenestration assembly, according to yet another embodiment of the present invention, that is similar to the fenestration assembly shown in FIG. 2B, except it does not include the optional foam material disposed around the frame, but instead includes a connecting member which allows the fenestration assembly to directly attach to a window or a window frame.

FIG. 2C shows a fenestration assembly 2000 which is substantially similar to fenestration assembly 1000 of FIG.

2B, except fenestration assembly 2000 includes an optional connecting member 2010. In other words, protective layer 2002, frame 2004, low-emittance film 2006 and desiccant 2008 of FIG. 2C are substantially similar to their counterparts in FIG. 2B, i.e., protective layer 1002, frame 1004, low-emittance film 1006 and desiccant 1008. Furthermore, fenestration assembly 2000 connects to a window or window frame using connecting member 2010, instead of foam material 1010 which is used by fenestration assembly 1000 of FIG. 2B.

Connecting member 2010 may be disposed on low-emittance film 2006 as shown in FIG. 2C, or in the alternative, on a surface of frame 2004 when low-emittance film 2006 does not extend the length of frame 2004. Regardless of the length of low-emittance film 2006, use of connecting member 2010 allows fenestration assembly 2000 to be directly attached to a window or window frame. By way of example, a connecting member in the form of magnets that is positioned on frame 2004 facilitates attaching fenestration assembly 2000 to a window frame.

In preferred embodiments of the present invention, connecting member 2010 includes at least one member selected from a group consisting of foam material, magnet, plastic, screw, tape and glue. In these embodiments, connecting member 2010 has a thickness that is between about 1/16 inch and about 6 inches.

Figure 2D:
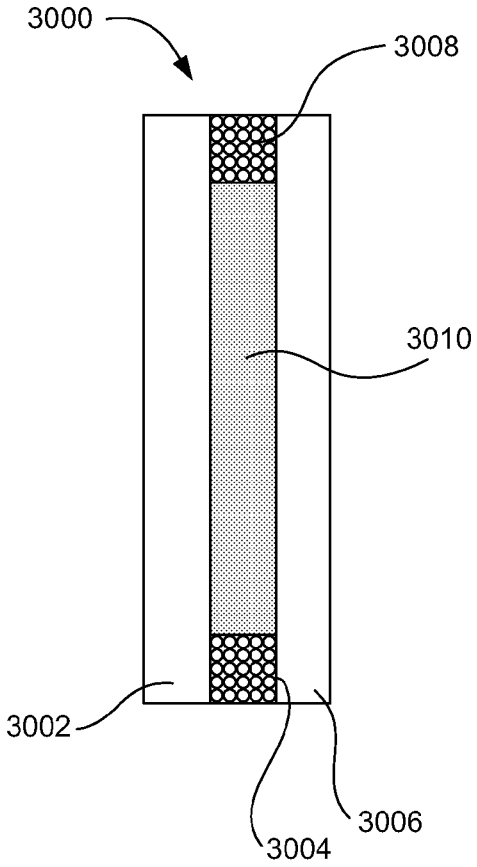
FIG. 2D shows a side-sectional view of yet another fenestration assembly, according to yet another embodiment of the present invention, that is similar to the fenestration assembly shown in FIG. 2B, except it does not include the optional foam material disposed around the frame, but instead includes a support layer disposed between a protective layer and a low-emittance film.

FIG. 2D shows yet another fenestration assembly 3000, according to yet another embodiment of the present invention. Fenestration assembly 3000 is substantially similar to fenestration assembly 2000 of FIG. 2C (i.e., protectively layer 3002, frame 3004, low-emittance film 3006 and desiccant 3008 are substantially the same as their counterparts in FIG. 2C), except fenestration assembly 3000 includes a support layer 3010 disposed between protective layer 3002 and low-emittance film 3006. In other words, where there was a dead space between the protective layer and the low-emittance film in FIG. 2C, in FIG. 2D the fenestration assembly has a support layer. Support layer 3010 serves to provide mechanical support to both protective layer 3002 and low-emittance film 3006. Supper layer 3010 may be made from at least one material selected from a group consisting of glass, plastic and polyester.

Figure 2E:
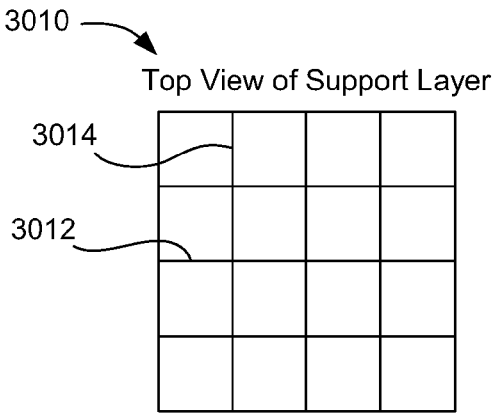
FIG. 2E shows a top view of the support lawyer shown in FIG. 2D.

FIG. 2E shows a top view of support layer 3010, which is preferably made from polyester. From this figure, it is clear that support layer 3010 may include one or more vertical support beams 3014 and one or more horizontal support beams 3012 that intersect each other at a 90° angle and form a grid. These beams have a thickness that is substantially equal to a thickness of frame 3004. As a result, the grid structure of support layer 3010 not only provides support and stability to protective layer 3002 and low-emittance film 3006, but serves to stabilize the entire fenestration assembly. Support layer 3010 in the form of a grid, as shown in FIG. 2E, represents a preferred embodiment of the present invention because it is a light-weight solution that is capable of carrying the load of both films. Moreover, the embodiment shown in FIG. 2D is ideally suited for skylight applications.

Figure 2F:
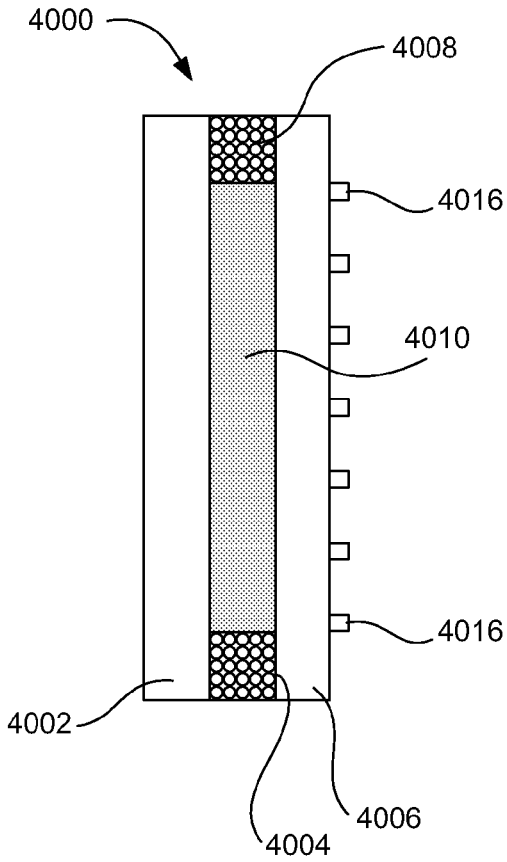
FIG. 2F shows a side-sectional view of yet another fenestration assembly, according to another embodiment of the present invention, that is similar to the fenestration assembly shown in FIG. 2D, but includes a plurality of mounts which directly contact a window surface when the fenestration assembly is installed to cover the window.

FIG. 2F shows yet another fenestration assembly 4000, according to yet another embodiment of the present invention. Fenestration assembly 4000 is substantially similar to fenestration assembly 3000 of FIG. 2D (i.e., protectively layer 4002, frame 4004, low-emittance film 4006, desiccant 4008 and support layer 4010 are substantially the same as their counterparts in FIG. 2D), except fenestration assembly 4000 includes mounts 4016 disposed on low-emittance film 4006.

Figure 2G:
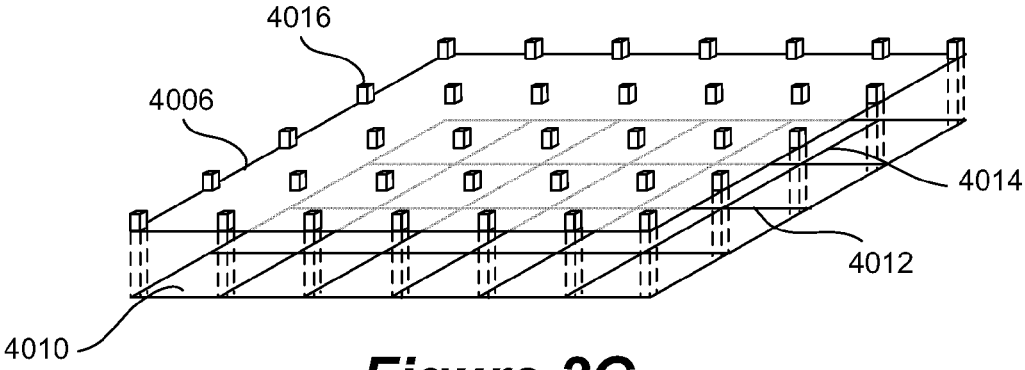
FIG. 2G shows a detailed perspective view of the mounts disposed above the low-emittance film as shown in FIG. 2F.

FIG. 2G shows a clearer view of the relationship between mounts 4016 and support layer 4010 underlying low-emittance film 4006. As shown in this figure, mounts are attached on low-emittance film 4006 at locations that correspond to points of intersection of the vertical support beams 4014 and horizontal support beams 4012. When fenestration assembly 4000 is installed on to a window or a window frame, mounts 4016 serve to define a space between low-emittance film and the window. It is not necessary that mounts 4016 be placed on the low-emittance film 4006, rather in certain embodiments of the present invention, mounts 4016 are placed on the protective layer 4002, as will be explained later in connection with FIG. 2H.

Figure 2H:
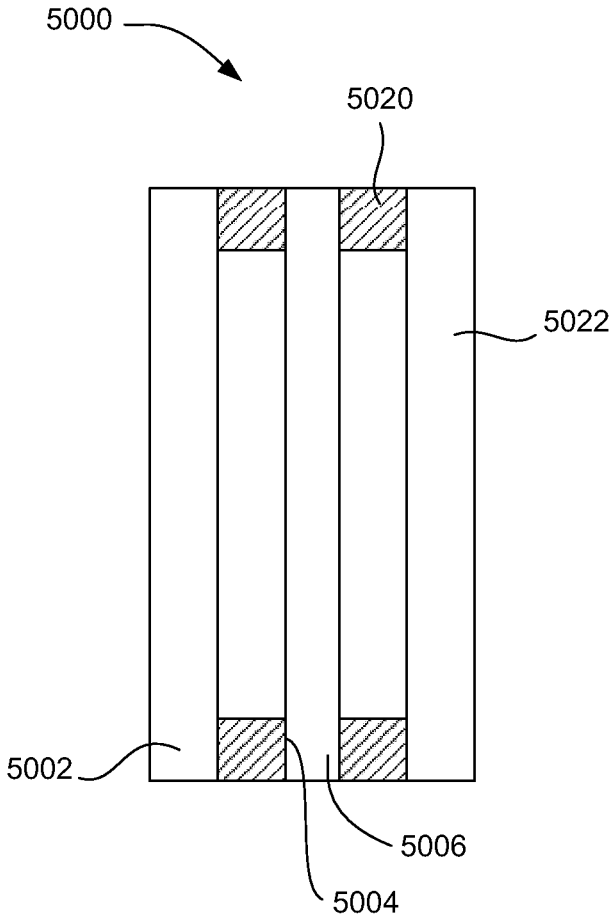
FIG. 2H shows a side-sectional view of yet another fenestration assembly, according to another embodiment of the present invention, which is in the form of a cartridge that includes, among other items, a low-emittance film sandwiched between two frames, each of which adheres to a protective film.

FIG. 2H shows a side-sectional view of yet another fenestration assembly 5000, according to yet another embodiment of the present invention. Fenestration assembly 5000 includes a low-emittance film 5006 sandwiched between two frames, i.e., frame 5004 and frame 5020. Each of these frames has protective layers adhering to their outer surface. Specifically, a relatively thin protective layer 5002 adheres to frame 5004 and a relatively thick protective layer 5022 adheres to frame 5022. In this embodiment, frames 5004 and 5020 are not hollow because there is no need to store a desiccant. When fenestration assembly 5000 is installed to cover a window, relatively thin protective layer 5002 is directly adjacent the window. In one embodiment of the present invention, relatively thin protective layer 5002 has a thickness that is between about 0.5 mils and about 6 mils and relatively thick protective layer 5022 has a thickness that is between about 2 mils and about ¼ inch.

In certain embodiments of the present invention, fenestration assembly 5000 may not include relatively thick protective layer 5022 and frame 5020. To effect the installation of this modified fenestration assembly, mounts, such as those shown in FIG. 2F, are used. Specifically, mounts are placed on protective layer 5002, as opposed to on low-emittance film 5006. After installation of the fenestration assembly, protective layer 5002, and not low-emittance film 5006, is directly adjacent the window.

Fenestration assemblies 3000, 4000 and 5000 of FIGS. 2D, 2F and 2H attach to a window or a window frame by preferably using foam material 1010 shown in FIG. 2B or using connecting member 2010 shown in FIG. 2C. When using foam material 1010 as shown in FIG. 2B, it is not necessary for fenestration assemblies 3000 and 5000 of FIGS. 2D and 2H, respectively, to have a space defined between them and the window. By way of example, low-emittance film 3006 of fenestration assembly 3000 may be flush up against a window, as opposed to being a certain distance away from the window. As another example, low-emittance film 5006 may be a certain distance away from a window and that distance can be dictated by the thickness of frame 5004 and thickness of relatively thin protective layer 5002. In this example, it is not necessary to introduce an appreciable distance between relatively thin protective layer 5002 and the window.

Various embodiments of inventive fenestration assemblies can be incorporated into different window assemblies, which are described hereinafter. FIG. 3 shows a side-sectional view of a window assembly 200, which includes a window 212 that is fitted with a fenestration assembly 100'. Fenestration assembly 100 of FIG. 2 and fenestration assembly 100' are substantially similar, except fenestration assembly is sized according to the dimensions of window 212. Specifically, according to FIG. 3, film 104' and frame 102' combine to provide fenestration assembly 100' with the appropriate height to cover the glass portion of window 212. Fenestration assembly 100' does not cover the entire or any part of frame 214. In the attached position of the fenestration assembly 100' and window 212, spacer 106', which is affixed to frame 102', creates a dead space between fenestration assembly 100' and window 212. The dead space is a gap between fenestration assembly 100' and window 212 which is filled with air.

This dead air gap significantly reduces the amount of heat conducted through window assembly 200. By way of example, for a building with 100,000 square feet of floor space having between about 15,000 square feet and about 20,000 square feet of clear glass windows, the dead air gap is believed to reduce energy consumption by a value that is between about 10% and about 30%. As another example, for the same building envelope as in the previous example, except where the windows are made from a film/window combination, energy consumption is reduced by between about 5% and about 15%. As yet another example, continuing with the same building envelope, when a larger tinted glass is used as a window, then the reduction in energy consumption is between about 5% and about 20%.

As a result, during summer seasons, a significant amount of heat absorbed by windows from the exterior of the building envelope is not conducted through window assembly 200 to the interior of the building envelope. This reduces the load on the air-conditioning system, which is designed to maintain interior of the building envelope at cooler temperatures.

Similarly, during winter months, a significant amount of heat absorbed by windows from the interior of the building envelope is not conducted through window assembly 200 to the exterior of the building envelope. As a result, during winter months, rate of heat transfer through window assembly 200 is significantly reduced. This reduces the load on the air-conditioning system that is designed to maintain interior of the building envelope at warmer temperatures.

FIG. 4A shows a side-sectional view of a window assembly 300, which includes a fenestration assembly 100" that is substantially similar to fenestration assembly 100 shown in FIG. 2, except that assembly 100" is sized to fit a window 312 and a surrounding frame 314. In other words, film 102" and frame 104" combine to provide assembly 100" a vertical height that covers window 312 and frame 314. In the attached position of the fenestration assembly 100" and window 312, spacer 106", which is affixed to frame 102", creates a dead space between fenestration assembly 100" and window 312.

The embodiment shown in FIG. 3 is preferably implemented when a wall extends to cover a frame portion (e.g., frame 214 of FIG. 3) of the window assembly and the embodiment shown in FIG. 4A is preferably implemented when a wall does not so extend and the frame portion of the window is exposed.

Figure 4B:
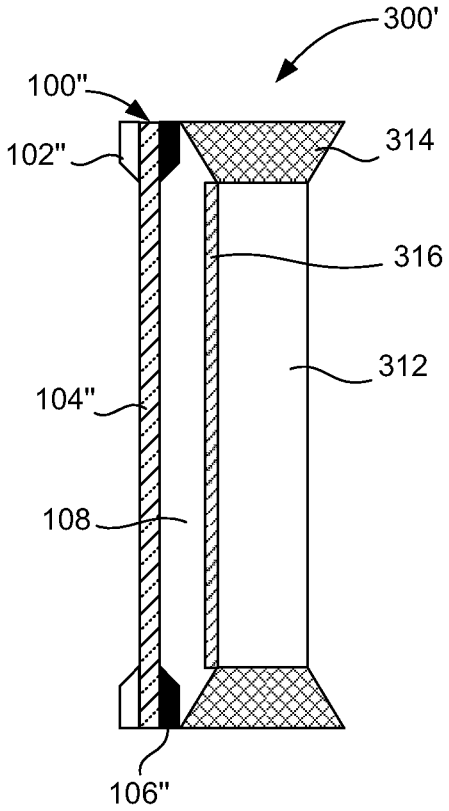
FIG. 4B shows a side-sectional view of the fenestration assembly shown in FIG. 2A that is sized to fit a surrounding window frame and a window, which has a film directly attached thereto.

FIG. 4B shows a side-sectional view of a fenestration assembly 300', which is substantially similar to fenestration assembly 300 of FIG. 4A, except that the interior side of window 312 has a film 316 adhered to it.

Although above-described embodiments of the present invention have been shown in the context of a single pane window, there are other preferred embodiments of the present invention which can be implemented in a window having a plurality of panes. Double pane windows which are frequently encountered in building envelopes from an energy conservation point of view and represent preferred embodiments of the present invention.

Figure 5A:
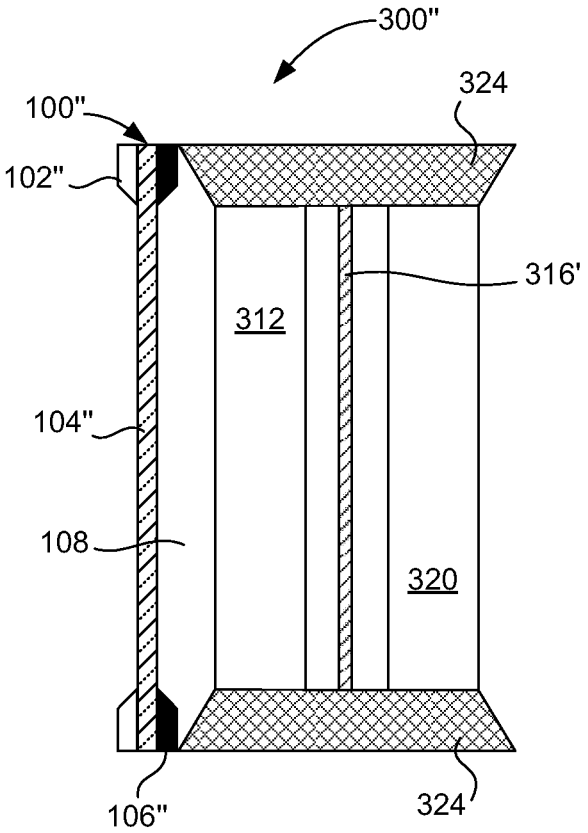
FIG. 5A shows a side-sectional view of the fenestration assembly shown in FIG. 2A that is sized to fit a double-pane window, which includes a film disposed between the interior and exterior panes.

To this end, FIG. 5A shows a side-sectional view of window assembly 300', which includes fenestration assembly 100" fitted on to a double-pane window having an interior pane 312 and an exterior pane 316. A frame 324 surrounds panes 312 and 316. Disposed between panes 312 and 320 is a film 316', which is reflective and reduces glare inside the building. Fenestration assembly 100" is substantially the same as the fenestration assembly 100" shown in FIGS. 4A and 4B. Film 316' may be substantially similar to film 316 in FIG. 4B. Furthermore, similar to FIGS. 4A and 4B, FIG. 5A also shows an air gap formed between fenestration assembly 100" and pane 312.

Figure 5B:
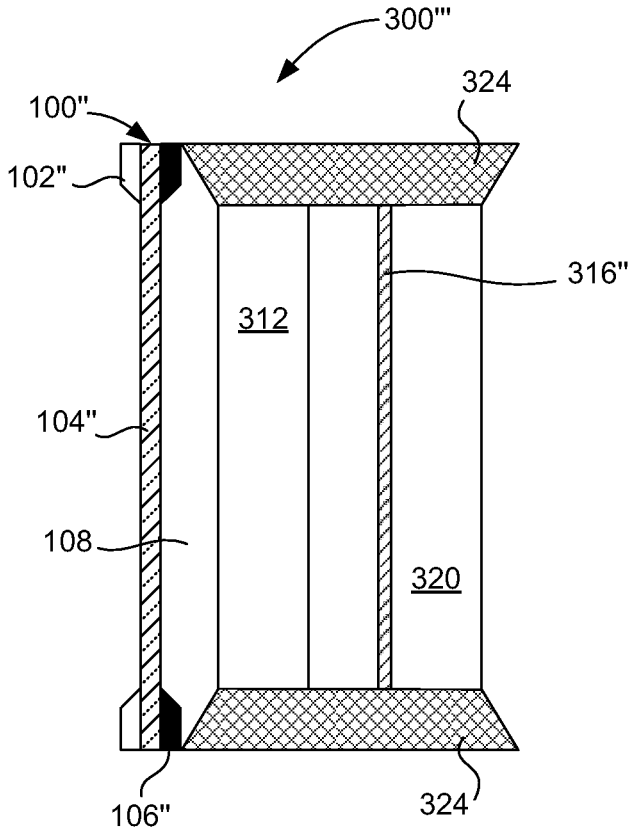
FIG. 5B shows a side-sectional view of the fenestration assembly shown in FIG. 2A that is sized to fit a double-pane window, which includes a glass coating manufactured on the inside surface of the exterior pane.

In FIG. 5B, a film 316", which may be substantially similar to film 316' shown in FIG. 5A, adheres to the inner surface of exterior pane 320. Otherwise, components of fenestration assembly 100' are found in substantially the same configuration as the fenestration assembly shown in FIGS. 4A, 4B and 5A.

Figure 6A:
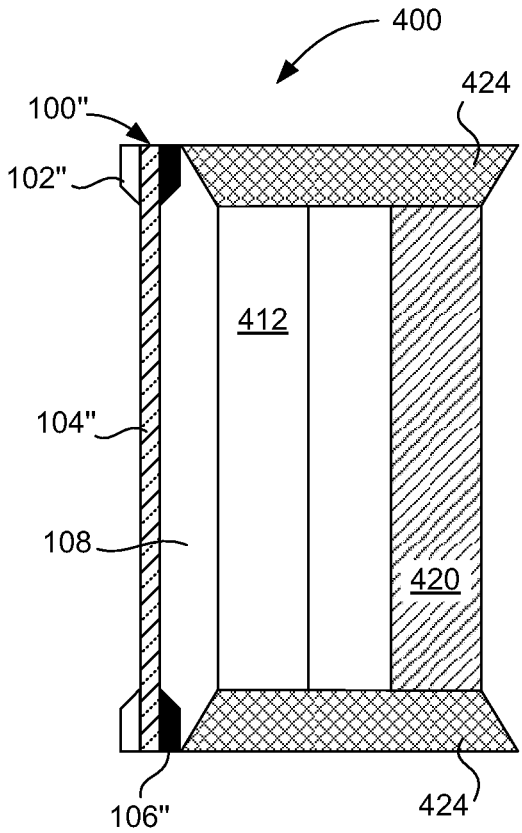
FIG. 6A shows a side-sectional view of the fenestration assembly shown in FIG. 2A that is sized to fit a double-pane window, in which the exterior pane has a low-emittance coating.
Figure 6B:
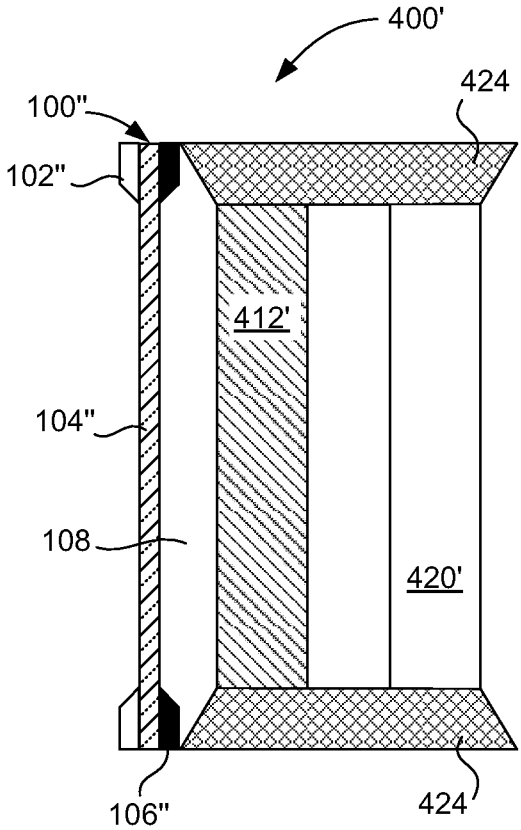
FIG. 6B shows a side-sectional view of the fenestration assembly shown in FIG. 2A that is sized to fit a double-pane window, in which the interior pane has a low-emittance coating.

In FIGS. 6A and 6B, instead of using a film, an e-coating low emissivity glass to reduce glare and increase reflectivity. Specifically, in the embodiment shown in FIG. 6A, outer panel 420 is made from an e-coating glass and in the embodiment shown in FIG. 6B, inner panel 420' is made from an e-coating glass. Other components (e.g., inner pane 412, outer pane 420 and frame 424) of the double pane window in FIGS. 6A and 6B are substantially similar to their counterparts (e.g., inner pane 312, outer pane 320 and frame 324) found in FIG. 5A.

Regardless of whether a single pane or a double pane window assembly is being fitted with a fenestration assembly according to the present invention, film 104 of FIG. 2A, film 104' of FIG. 3, film 104" of FIGS. 4A, 4B, 5A, 5B, 6A and 6B, can be replaced with a "sandwiched insert between films assembly." According to one embodiment of the "sandwiched insert between films assembly," the present invention provides an insert, typically made from plastic that is sandwiched on both sides by two films, which can be of different types, but need not be.

Those skilled in the art will recognize that instead of fenestration assemblies similar to the one shown in FIG. 2A, fenestration assemblies described in FIGS. 2B-2H may be similarly incorporated into the embodiments of window assemblies shown in FIGS. 3, 4A, 4B, 5A, 5B, 6A, and 6B.

The present invention also describes methods of making the above-described fenestration assemblies. In one embodiment of the present invention, the process of making a fenestration assembly (e.g., assembly 100 of FIG. 2A) begins when a frame, preferably made from a metallic material, is obtained. It is not necessary, but in those instances where the frame surrounding the window is exposed, the frame should be sized to fit over the window as well as the surrounding frame. However, if a wall covers or another object obstructs the frame surrounding the window, then it is preferable to size the frame to fit over only the window. Next, an appropriate film of appropriate reflectance should be selected. A film having a high reflectivity is desired from a functional standpoint, but typically such highly reflective films suffer from an aesthetic point of view. As a result, the present invention recognizes that it is important to strike a balance between aesthetics and functionality. In light of this realization, in a preferred embodiment of the present invention, the reflectance of the film (e.g., film 104 of FIG. 2A) is between about 6% and 60% and in more preferred embodiments of the present invention; the reflectance of the film is between about 8% and about 45%. The selected film may have a thickness that is in the range described above. However, for a window size that is between about 2 ft×2 ft, the film thickness is preferably between about 8 mils and 10 mils and for a window size that is greater than about 2 ft×2 ft, the film thickness is preferably between about 12 mils and 14 mils. The present invention recognizes that as the dimensions of the window get greater, it is preferably to use a film that is thicker. Furthermore, the present invention also recognizes that large dimensions of film also lend themselves to easier cleaning. Films with large dimensions and which are not of requisite thickness are too flimsy and difficult to clean.

In certain preferred embodiments of the present invention, after the spacer is adhered to the frame of the fenestration assembly, a moisture gel or barrier is applied to the frame along its periphery. The present invention recognizes that sunlight strikes the above-described fenestration assemblies, during their normal use, producing moisture inside the dead air space between the window and the film. The presence of moisture gel serves to remove this moisture during normal use of the fenestration assemblies. It is important to note that the moisture gel can be applied at any location on the frame so long as the gel exists between the film and the window or, alternatively, is at a location that effectively removes the moisture from the dead space.

The selected film may then be secured on the frame using conventional techniques. By way of example, double sticky tape can be used to adhere the film onto the frame. Other examples of securing film to the frame include using glue, hot glue and epoxy. However, double-sticky tape represents a preferred embodiment because it weathers well.

Next, spacers (e.g., spacers 106 of FIG. 2) which acts a sealing component is applied to the periphery of the frame. By way of example, a conventional foam sealant adheres the spacer to the frame. In accordance with one preferred embodiment of the present invention, spacer is "closed cell" foam, as it does not allow air to pass through the air space that is created between the frame of the fenestration assembly and the frame of the window or window itself, as shown in FIGS. 3 and 4A, respectively. Without the flow of air through this air space an effective dead space is created.

Once the fenestration assemblies of the present invention are formed, they are secured to fit onto a window, as described above, forming window assemblies.

In certain other embodiments of the present invention, the above-described fenestration assemblies are not assembled first and then fitted onto the window. Rather, in these embodiments, fenestration assemblies are fabricated one component at a time fabricated directly on the window frame or window, depending on the desired outcome (e.g., either FIG. 3 where the fenestration assembly is fabricated on the window, or FIG. 4A where the fenestration assembly is fabricated on the window frame to cover at least part of the window frame and window).

Other embodiments described in FIGS. 2B-2H are similarly fabricated. In other words, various components, such as protective layer or film, supporting layer or film, mounts, connecting member, and foam material adhere to other components such as frames and other films using conventional techniques (e.g., glue and tape). In those embodiments where accumulation of moisture poses a risk, desiccants described herein may be incorporated into the frame or applied to the low-emittance film by any number of well-known techniques. Moreover, once the fenestration assemblies of the present invention are fabricated, a decorative frame may be installed around them to appropriate present the energy-reduction solution of the present invention.

Although illustrative embodiments of this invention have been shown and described, other modifications, changes, and substitutions are intended. Accordingly, it is appropriate that the appended claims be construed broadly and in a manner consistent with the scope of the disclosure, as set forth in the following claims.

What is claimed is:

1. A fenestration assembly comprising:

a frame having a first surface and a second surface, which is opposite to said first surface, said frame having a thickness;

a protective layer attached to said first surface and said first surface surrounding said protective layer;

a film attached to and surrounded by said second surface of said frame, such that said thickness of said frame defines a space between said protective layer and said film;

a support layer disposed between said protective layer and said film such that said support layer supports said film and said protective layer; and wherein said support layer includes a polyester film that includes one or more vertical support beams and one or more horizontal support beams that intersect each other at approximately 90° and form a grid, and said one or more vertical support beams and said one or more horizontal support beams have a thickness that is substantially equal to the thickness of said frame.

2. The fenestration assembly of claim 1, further comprising a plurality of mounts, each of which are positioned on film at a location that corresponds to the point of intersection of said one or more vertical support beams and said one or more horizontal support beams of said support film, wherein said mounts maintain a distance between said film and said window when said fenestration assembly is installed on a window or a window frame.

3. The fenestration assembly of claim 2, wherein said distance between said film and said window is between about ⅙ inch and about 6 inches.

4. The fenestration assembly of claim 1, wherein said film is positioned adjacent to a window when said fenestration assembly is installed to cover said window and said film in that configuration is designed to reduce energy loss through said window.

5. The fenestration assembly of claim 1, wherein said film is a low-emittance film having an emissivity equal to or less than about 0.35.

* * * * *